US008196742B1

(12) United States Patent
Wang

(10) Patent No.: US 8,196,742 B1
(45) Date of Patent: Jun. 12, 2012

(54) TOOL BIT TOOLBOX

(76) Inventor: Tzu-Chien Wang, Tainan (TW)

( * ) Notice: Subject to any disclaimer, the term of this patent is extended or adjusted under 35 U.S.C. 154(b) by 0 days.

(21) Appl. No.: 13/106,267

(22) Filed: May 12, 2011

(51) Int. Cl.
*B65D 85/20* (2006.01)
*B65D 5/52* (2006.01)

(52) U.S. Cl. ..... 206/379; 206/45.23

(58) Field of Classification Search ..... 206/45.2, 206/45.23, 372, 373, 377–379; 211/70.6
See application file for complete search history.

(56) References Cited

U.S. PATENT DOCUMENTS 2,527,161 A * 10/1950 Tyll ..... 206/372
2,880,857 A * 4/1959 Parsons et al. ..... 206/379
6,615,983 B1 * 9/2003 Yu ..... 206/372
RE38,905 E * 12/2005 Wei ..... 206/373
7,021,464 B2 * 4/2006 Chen ..... 206/379
7,699,176 B2 * 4/2010 Lin ..... 206/379
8,016,108 B1 * 9/2011 Hung ..... 206/379
2008/0053853 A1 * 3/2008 Kao ..... 206/377

* cited by examiner

*Primary Examiner* — Bryon Gehman

(57) ABSTRACT

A toolbox includes a base having a compartment with a bottom wall. A cover is pivotably connected to the base. A bit seat is received in the compartment and pivotably connected to the base. The bit seat includes a plurality of bit grooves for receiving bits. When the bit seat is in a storage position, a longitudinal axis of each bit groove is parallel to the bottom wall of the base, and the bits are received in the compartment. An abutment portion of the bit seat abuts a rib on the bottom wall when the bit seat is in an extended position. The cover and the base can be in an inverted V-shaped state and can be placed on a platform while the abutment portion of the bit seat abuts the rib under action of weights of the bits, retaining the bit seat is in the extended position.

11 Claims, 8 Drawing Sheets

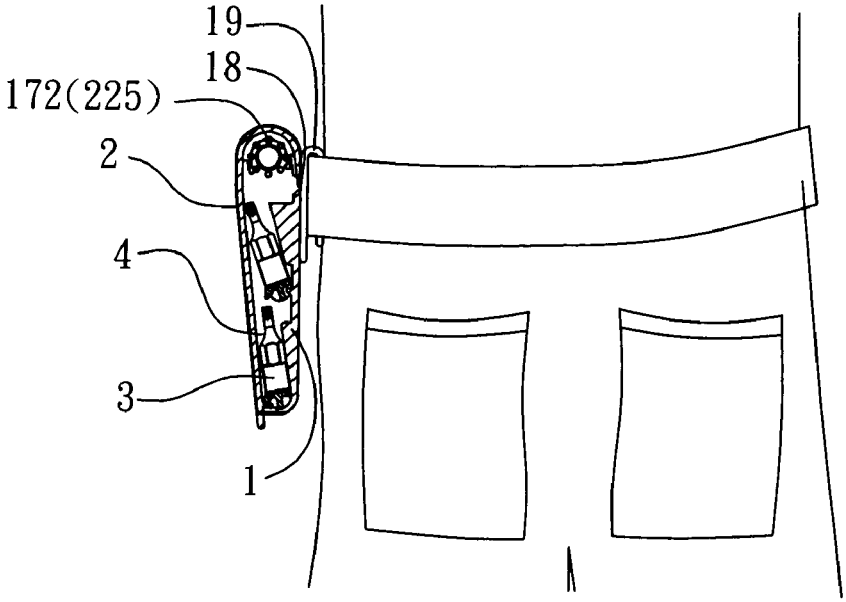
FIG. 4
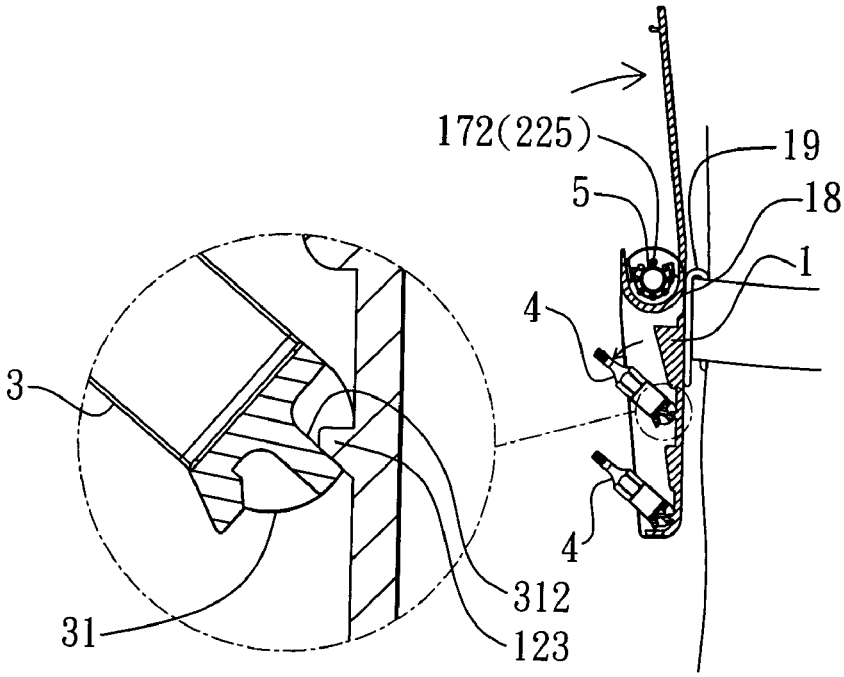
FIG. 5A
FIG. 5

B-B

TOOL BIT TOOLBOX

BACKGROUND OF THE INVENTION

The present invention relates to a toolbox and, more particularly, to a toolbox that is easy to carry while meeting display purposes and allowing easy access to the bits received in the toolbox.

Conventional screwdrivers include tips of differing sizes and types corresponding to screws of differing sizes and types. To avoid inconvenient carriage and storage of various screwdrivers, a screwdriver including a shank for releasably coupling with one of a set of bits has been proposed, and the bits can be placed in a smaller toolbox for easy carriage and storage.

FIG. 10 shows a conventional toolbox including a base 1' and a cover 2'. The base 1' includes a plurality of grooves 11' for receiving various bits 3'. The cover 2' is made of transparent material and can be pivoted to a position closing the base 1'. A hook (not shown) is provided on an outer side of the base 1' or the cover 2' and can be hooked on a belt of a user for carriage. However, the bits 3' are received in the grooves 11' of the base 1' in an upright manner, such that the toolbox has a large thickness and a large volume and is, thus, not easy to carry. Furthermore, the toolbox can not be placed upright, failing to provide display effect.

FIGS. 11 and 12 show another conventional toolbox including a base 4' and a cover 5'. The base 4' includes two bit seats 41' pivotable relative to the base 4'. A plurality of bits 3' is received in each bit seat 41'. A torsion spring 42' is mounted to each bit seat 41' and includes two ends respectively pressing against the base 4' and the bit seat 41'. An end of the cover 5' is pivoted to the base 4' and can be moved between an open position and a closing position. The bit seats 41' pivot when the cover 5' is being closed, moving the bits 3' to a horizontal position to reduce the thickness of the toolbox in the closed state. When the cover 5' is opened, the bit seats 41' are moved to an extended position under the bias of the torsion springs 42', allowing removal of the bits 3'. However, the toolbox can not be placed upright when the cover 5' is opened, failing to provide display effect. Furthermore, the torsion springs 42' required for moving the bit seats 41' to the extended positions cause an increase in the part costs and the assembling costs. Furthermore, the bit seats 41' can not be moved to the extended positions when the torsion springs 42' fatigue.

BRIEF SUMMARY OF THE INVENTION

An objective of the present invention is to provide a toolbox that meets display purposes and allows easy access to the bits received in the toolbox.

A toolbox according to the present invention includes a base having a compartment with a bottom wall. Two sidewalls and front and rear walls extend perpendicularly from the bottom wall. The front and rear walls are spaced in a length direction. A first rib is formed on the bottom wall. An extension extends rearward in the length direction from a rear end of each of the lateral walls. A cover includes a rear end having an extension. The extension of the cover is pivotably connected to the extensions of the two lateral walls of the base. A first bit seat is received in the compartment of the base. The first bit seat includes a first pivotal column pivotably connected to the base. The first bit seat further includes a first abutment portion. The first pivotal column includes an outer periphery having a plurality of first bit grooves for receiving a plurality of first bits. The first bit seat is pivotable between a storage position and an extended position. When the first bit seat is in the storage position, a longitudinal axis of each of the plurality of first bit grooves is parallel to the bottom wall of the base, and the plurality of first bits is received in the compartment. The first abutment portion of the first bit seat abuts the first rib of the base when the first bit seat is in the extended position.

The first bit seat is retained in the storage position when the cover is in a closing position covering the compartment of the base. The cover is pivotable relative to the base to a position in which the cover and the base are in an inverted V-shaped state and placeable on a platform. The first abutment portion of the first bit seat abuts the first rib of the base under action of weights of the plurality of first bits, retaining the first bit seat is in the extended position.

Preferably, the longitudinal axis of each of the plurality of first bit grooves inclines towards an outer face of the base and is at an acute angle to the vertical axis.

Preferably, the base further includes first and second mounting plates on the bottom wall and including a pair of aligned pivot holes. Each of the pivot holes includes an opening defined in an upper end thereof and having a width smaller than a diameter of the pivot hole. An inclined face extends upward from an edge of each of the openings. Each of the first and second mounting plates further includes a recess having a wall contiguous to the inclined face, allowing expansion of the opening. The first pivotal column includes two ends each having an axle pivotably received in one of the pivot holes.

Preferably, the first rib extends in a direction parallel to a pivot axis defined by the pivot holes of the mounting plates. The first abutment portion of the first bit seat is located on the first pivotal column.

Preferably, the bottom wall of the base further includes a plurality of partitioning plates each extending in the length direction. A receiving space is defined between two adjacent partitioning plates. Each of the plurality of first bit grooves is aligned with one of the plurality of partitioning plates.

Preferably, the extension of the cover includes a rear end having a downwardly extending peripheral wall. The extension of the cover further includes two lateral walls between which the peripheral wall extend. A receiving space is defined between the peripheral wall and the lateral walls.

Preferably, each of the extensions of the base includes a pivot hole. A plurality of positioning holes is located around the pivot hole of each of the extensions of the base. A pivotal portion is provided on each of the two lateral walls of the cover and pivotably engaged with the pivot holes of the extensions of the base. Each of the pivotal portions of the cover includes a positioning member engaged with one of the plurality of positioning holes of one of the extensions of the base and with an outer face of the peripheral wall of the cover abutting the rear wall of the base when the base and the cover are in the inverted V-shaped state.

Preferably, the front wall of the base includes an inner face having an engagement section, with the cover including a covering portion. The covering portion covers the compartment when the cover is in the closing position. The covering portion includes a front end having an engaging member. The engaging member engages with the engagement section of the base when the cover is in the closing position.

Preferably, the base includes a rear face having a coupling portion, and a hook is provided on the coupling portion.

Preferably, the bottom wall includes a second rib spaced from the first rib in the length direction. The toolbox further includes a second bit seat received in the compartment of the base and spaced from the first bit seat in the length direction. The second bit seat includes a second pivotal column pivotably connected to the base. The second bit seat further includes a second abutment portion. The second pivotal column includes an outer periphery having a plurality of second bit grooves for receiving a plurality of second bits. The second bit seat is pivotable between a storage position and an extended position. When the second bit seat is in the storage position, a longitudinal axis of each of the plurality of second bit grooves is parallel to the bottom wall of the base, and the plurality of second bits is received in the compartment. The with the second abutment portion of the second bit seat abuts the second rib of the base when the second bit seat is in the extended position. The second bit seat is retained in the storage position when the cover is in a closing position closing the compartment of the base. The second abutment portion of the second pivotal column abuts the second rib of the base under action of weights of the plurality of second bits when the base and the cover are in the inverted V-shaped state, retaining the second bit seat is in the extended position.

The present invention will become clearer in light of the following detailed description of illustrative embodiments of this invention described in connection with the drawings.

DESCRIPTION OF THE DRAWINGS

FIG. 4 shows a view illustrating the toolbox of FIG. 1 carried on a belt worn by a user.

FIG. 5 shows a view similar to FIG. 4, with the cover opened.

FIG. 5A shows an enlarged view of a circled portion of FIG. 5.

DETAILED DESCRIPTION OF THE INVENTION

Figure 1:
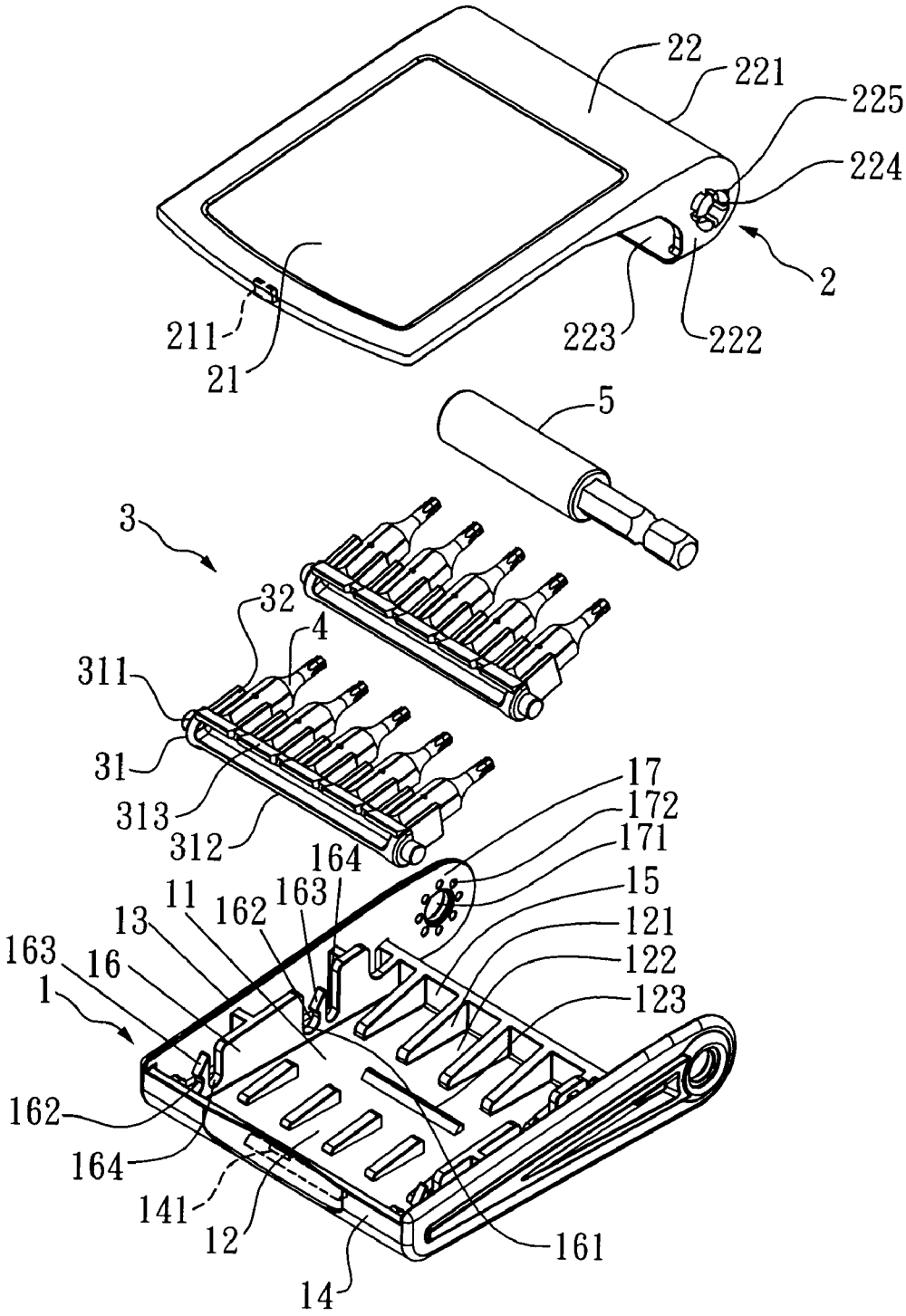
FIG. 1 shows an exploded, perspective view of a toolbox according to the present invention.
Figure 2:
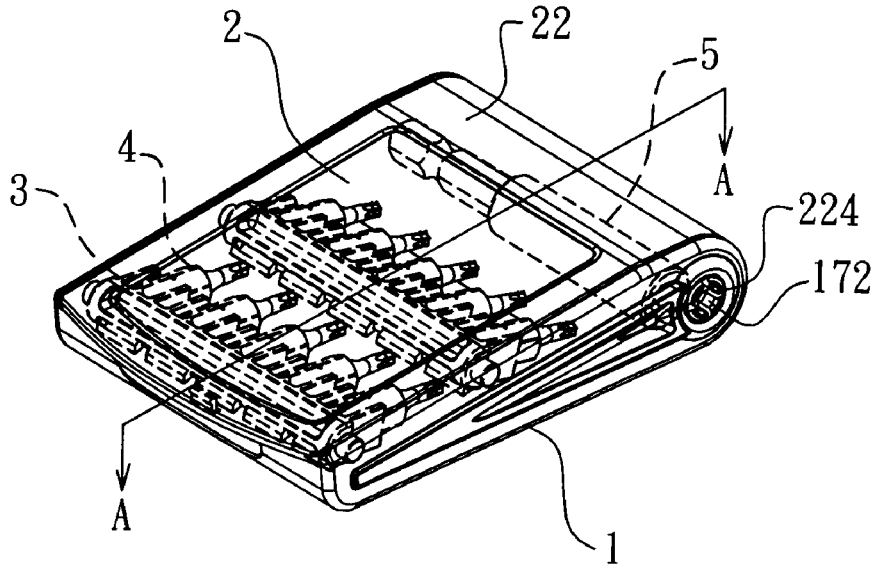
FIG. 2 shows a perspective view of the toolbox of FIG. 1, with a cover of the toolbox in a closing position.
Figure 3:
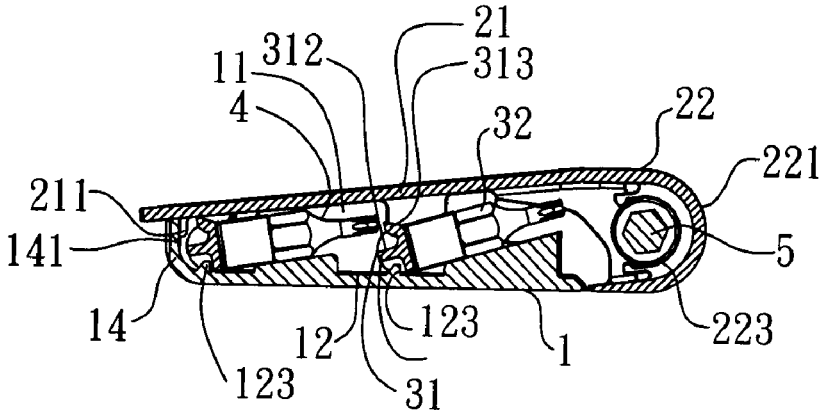
FIG. 3 shows a cross sectional view taken along section line A-A of FIG. 2.

With reference to FIGS. 1-3, a toolbox according to the present invention includes a base 1, a cover 2, and two bit seats 3. The base 1 includes a compartment 11 having a bottom wall 12. Two sidewalls 13 and front and rear walls 14 and 15 extend perpendicularly from the bottom wall 12. The front and rear walls 14 and 15 are spaced in a length direction and extend between the sidewalls 13. Two mounting plates 16 are provided on the bottom wall 12 and respectively adjacent to the sidewalls 13. Each mounting plate 16 includes two pivot holes 161 spaced in the length direction. Each pivot hole 161 of one of the mounting plates 16 is aligned with one of the pivot holes 161 of the other mounting plates 16. Each pair of aligned pivot holes 161 defines a pivot axis. Each pivot hole 161 includes an opening 162 defined in an upper end thereof and having a width smaller than the diameter of the pivot hole 161. Each mounting plate 16 further includes an inclined face 163 extending upward from an edge of each opening 162. Each mounting plate 16 further includes two recesses 164 each having a wall contiguous to one of the inclined faces 163. Each recess 164 provides a room for expansion of one of the openings 162. The bottom wall 12 further includes a plurality of partitioning plates 121 extending in the length direction. A receiving space 122 is defined between two partitioning plates 121 adjacent to each other. Two ribs 123 are provided on the bottom wall 12 and spaced in the length direction and each extend in a direction parallel to the pivot axis of a pair of pivot holes 161. An extension 17 extends rearward in the length direction from a rear end of each sidewall 13 and includes a pivot hole 171. A plurality of positioning holes 172 is located around the pivot hole 171 of each extension 17. An engagement section 141 is provided on an inner face of the front wall 14. With reference to FIG. 4, a coupling section 18 is provided on a rear face of the base 1. A hook 19 is mounted to the coupling section 18 and can hook on a belt worn by a user.

The cover 2 is made of transparent material and can cover the compartment 11 of the base 1. The cover 2 includes a front end having a covering portion 21. An extension 22 extends from a rear end of the cover 2 and is located between the extensions 17 of the base 1. An engaging member 211 is provided on an inner face of a front end of the covering portion 21 for engaging with the engagement section 141 of the base 1. The extension 22 includes a rear end having a downwardly extending peripheral wall 221. The extension 22 further includes two lateral walls 222 between which the peripheral wall 221 extend. A receiving space 223 is defined between the peripheral wall 221 and the lateral walls 222. A bit coupling shank 5 can be received in the receiving space 223. A pivotal portion 224 provided on each lateral wall 222 and includes a positioning member 225. In the form shown, the pivotal portion 224 on each lateral wall 222 includes a plurality of annularly spaced resilient plates on an outer face of the lateral wall 222. The positioning member 225 is in the form of a protrusion on one of the resilient plates.

Figure 7:
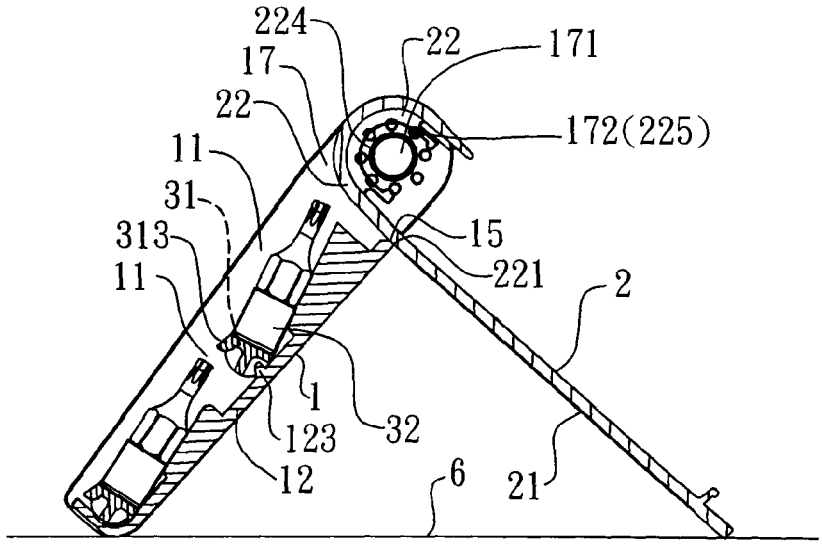
FIG. 7 shows a cross sectional view of the toolbox of FIG. 1, wherein a cover and a base of the toolbox are substantially inverted V-shaped in cross section and are placed on a surface and wherein pivotal seats of the toolbox are in a storage position.

The pivotal portions 224 on the rear end of the cover 2 are pivotably connected to the pivot holes 171 of the extensions 17 of the base 1, such that the cover 2 can pivot relative to the base 1 and can be retained in a desired angular position by engagement of the positioning member 225 of each pivotal portion 224 with one of the positioning holes 172 of one of the extensions 17. With reference to FIG. 3, when cover 2 is in a closing position, the engaging member 211 of the cover 2 is engaged with the engagement section 141 of the cover 1 to retain the cover 2 in the closing position. With reference to FIG. 7, the cover 2 can be pivoted relative to the base 1 to a position in which the covering portion 21 faces the rear face of the base 1. The cover 2 and the base 1 are in a substantially inverted V-shaped state and can be placed on a surface or platform 6. The positioning members 225 of the cover 2 engage with corresponding positioning holes 172 of the base 1 to retain the relative angular position between the cover 2 and the base 1. The outer face of the peripheral wall 221 of the cover 2 abuts the rear wall 15 of the base 1, providing enhanced support for retaining the cover 2 and the base 1 in the inverted V-shaped state.

Figure 9:
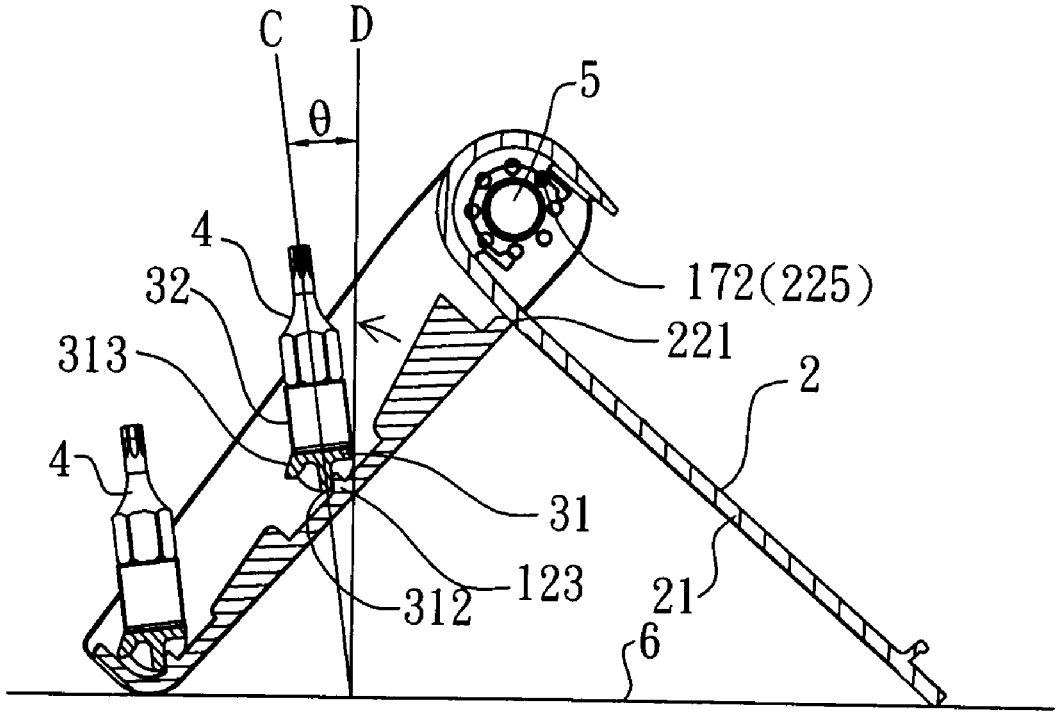
FIG. 9 shows a cross sectional view taken along section line B-B of FIG. 8.
Figure 10:
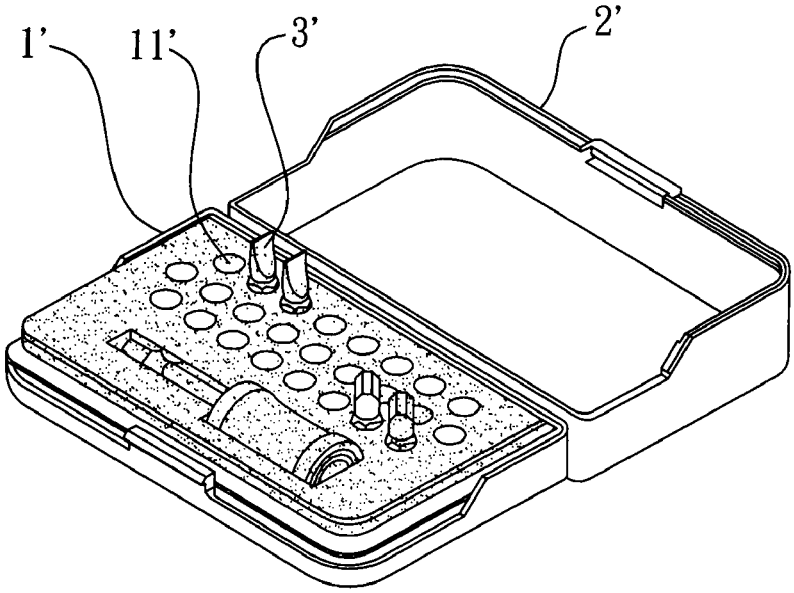
FIG. 10 shows a perspective view of a conventional toolbox.
Figure 11:
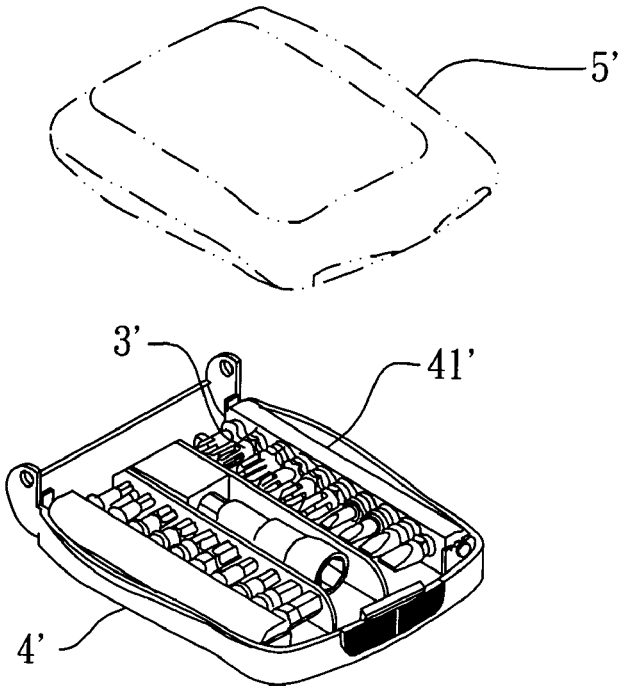
FIG. 11 shows an exploded, perspective view of another conventional toolbox.
Figure 12:
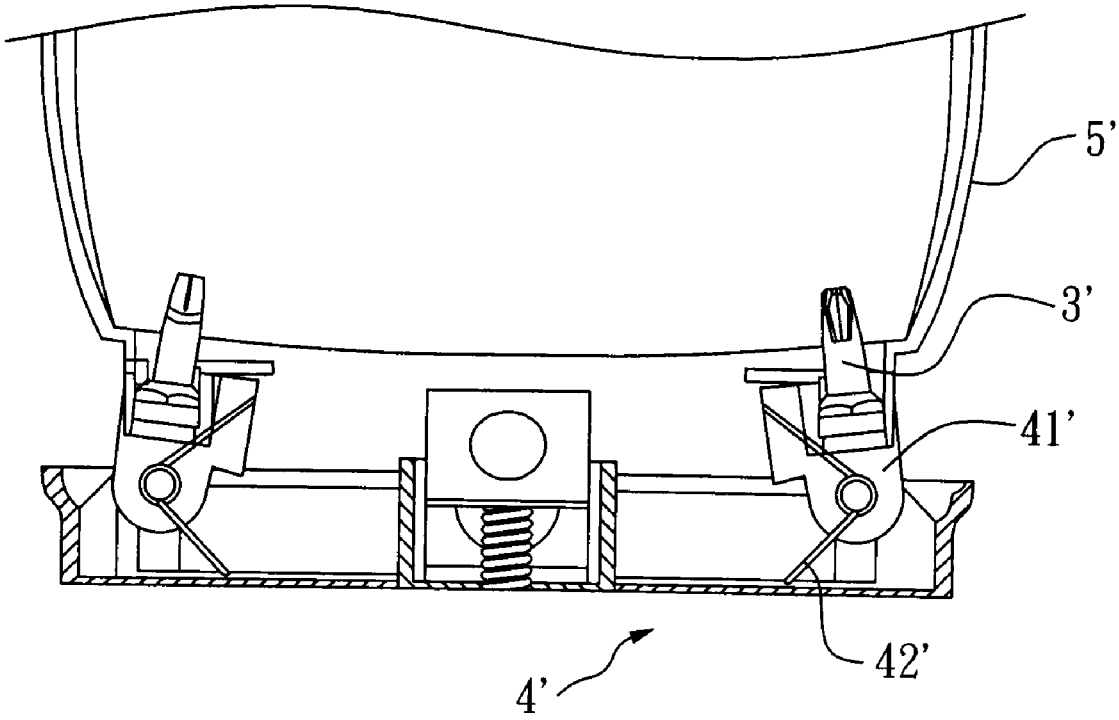
FIG. 12 shows a partial, cross sectional view of the conventional toolbox of FIG. 11.

Each bit seat 3 is received in the compartment 11 of the base 1 and includes a pivotal column 31. Each bit seat 3 is mounted to the base 1 and pivotable between a storage position and an extended position. Specifically, each of two ends of the pivotal column 31 of each it seat 3 includes an axle 311. The axles 311 of each bit seat 3 are inserted into a pair of aligned pivot holes 161 of the mounting plates 16 of the base 1. A plurality of bit grooves 32 is defined in an outer periphery of the pivotal column 31 of each bit seat 3 for receiving bits 4. The axles 311 of each bit seat 3 can slide along the inclined faces 163 of the mounting plates 16 on the base 1 into the pivotal holes 161. Each bit seat 3 further includes an abutment portion 312. When each bit seat 3 is in the storage position, a longitudinal axis C of each bit groove 32 is parallel to the bottom wall 12 of the base 1 and aligned with one of the receiving space 122 of the base 1. Thus, the bits 4 can be received in the compartment 11 to reduce the thickness of the toolbox in the storage position, as shown in FIGS. 2 and 3. On the other hand, when each bit seat 3 is pivoted to the extended position, the abutment portion 312 of each bit seat 3 abuts against one of the ribs 123 of the base 1, retaining the bit seat 3 in the extended position. With reference to FIG. 9, when the cover 2 and the base 1 are in the inverted V-shaped state and placed on the platform 6, abutment of the abutment portions 312 against the ribs 123 retains the longitudinal axis C of each bit groove 32 is at an acute angle θ to a vertical axis D perpendicular to the platform 6. Each pivotal column 31 includes a protruded portion 313 allowing manually pivoting the bit seat 3.

Figure 6:
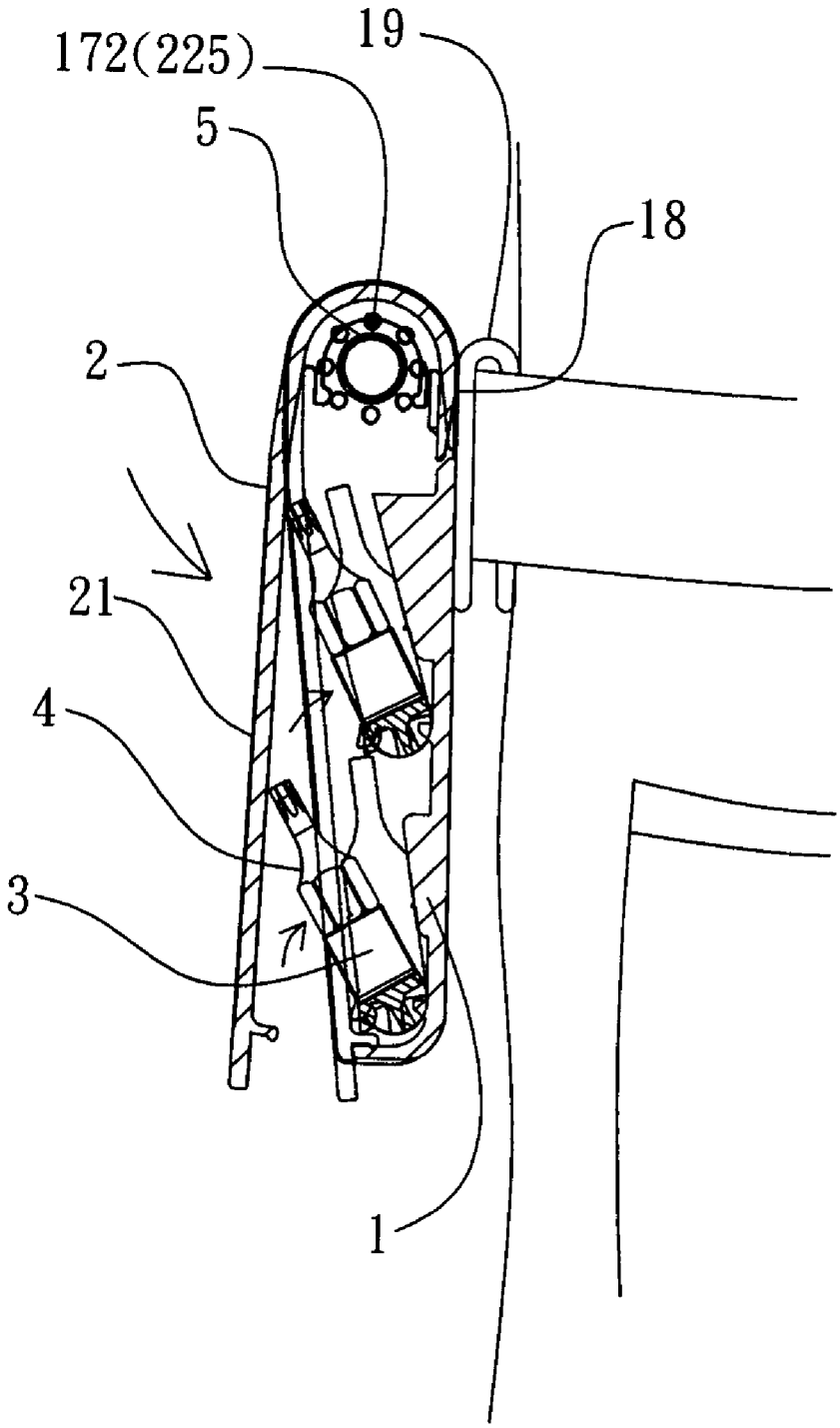
FIG. 6 shows a view illustrating closing of the cover of the toolbox carried on the belt.

The bit grooves 32 of the bit seats 3 receive various bits 4. With reference to FIGS. 2 and 3, when the bit seats 3 are in the storage position, the bits 4 are received in the compartment 11 to reduce the storage volume. The cover 2 covers the compartment 11 of the base 1 to retain the bit seats 3 in the storage position. With reference to FIG. 4, the hook 19 on the base 1 can be engaged with the belt of the user to allow easy carriage. The bottom wall 12 is perpendicular to the ground. With reference to FIGS. 5 and 5A, when the cover 2 is opened, the bit seats 3 pivot to the extended positions under the action of the weights of the bits 4, and the abutment portions 312 abut against the ribs 123 of the base 1. Thus, each bit 4 is inclined to allow easy removal by the user. With reference to FIG. 6, when the user moves the cover 2 to the closing position, the inner face of the covering portion 21 of the cover 2 presses against the tips of the bits 4, imparting pivoting force to pivot the bit seats 3 to the storage position, allowing easy operation.

Figure 8:
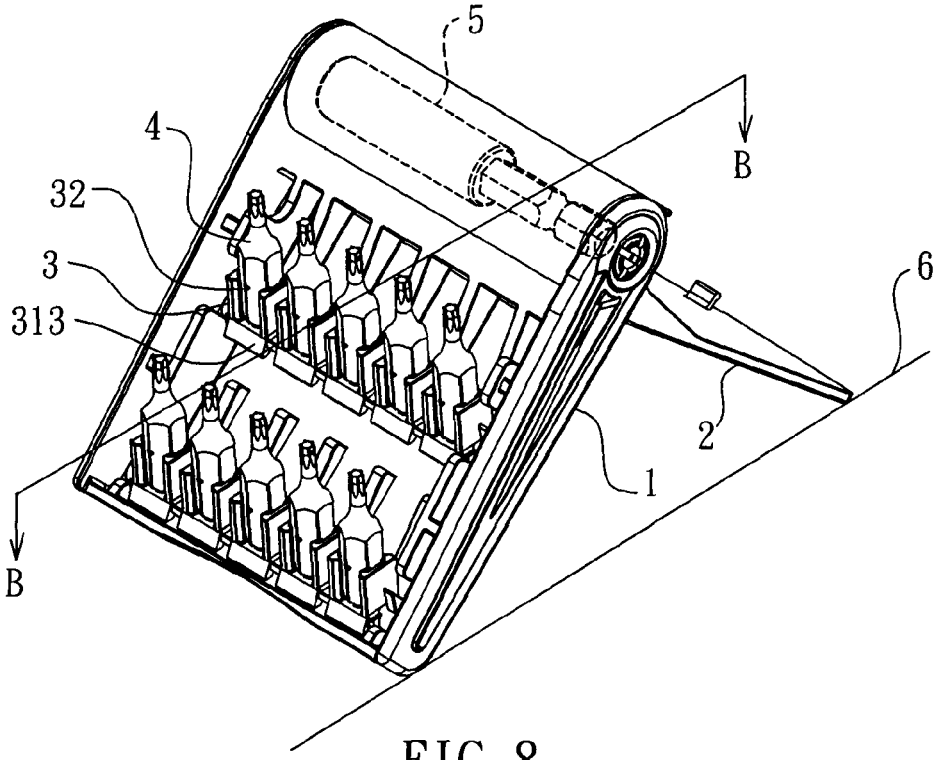
FIG. 8 shows a perspective view of the toolbox of FIG. 7, wherein each pivotal seat of the toolbox is in an extended position.

With reference to FIGS. 7-9, the cover 2 and the base 1 can be in the inverted V-shaped state and placed on the platform 6 for display purposes. The abutment portions 312 abut the ribs 123 of the base 1 by manually pivoting the protruded portions 313 or under the action of the weights of the bits 4. The bits 4 are located approximately corresponding to the vertical axis D of the platform 6, providing the best exhibition angle. The bits 4 are larger at lower ends thereof and, thus, provide lower, stable centers of gravity. In this embodiment, the longitudinal axis C of each bit groove 32 inclines towards the outer face of the base 1 and is at an acute angle θ to the vertical axis D perpendicular to the platform 6. Thus, each bit 4 is retained in a position substantially corresponding to the vertical axis D, providing stable display function while allowing easy removal of the bits 4.

The toolbox according to the present invention provides display function and can be easily carried. The bit seats 3 can be retained in the extended position by the weights of the bits 4 without using springs. The disadvantages resulting from fatigue of springs can be avoided. Furthermore, the toolbox according to the present invention is light and small. The display function and easy carriage of the toolbox will not be adversely affected even if the toolbox does not include the hook 19. Furthermore, the bit seats 3 can be directly pivoted to the sidewalls 13 of the base 1. Further, the toolbox can include only one bit seat 3, one pair of pivot holes 161, and one rib 123.

Although specific embodiments have been illustrated and described, numerous modifications and variations are still possible without departing from the essence of the invention. The scope of the invention is limited by the accompanying claims.

The invention claimed is:

1. A toolbox comprising:

a base including a compartment having a bottom wall, with two sidewalls and front and rear walls extending perpendicularly from the bottom wall, with the front and rear walls spaced in a length direction, with a first rib formed on the bottom wall, with a respective extension extending rearward in the length direction from a rear end of each of the two sidewalls;

a cover for covering the compartment of the base, with the cover including a rear end having an extension, with the extension of the cover pivotably connected to the two extensions of the two sidewalls of the base; and a first bit seat received in the compartment of the base, with the first bit seat including a first pivotal column pivotably connected to the base, with the first bit seat further including a first abutment portion, with the first pivotal column including an outer periphery having a plurality of first bit grooves for receiving a plurality of first bits, with the first bit seat pivotable between a storage position and an extended position, with a longitudinal axis of each of the plurality of first bit grooves parallel to the bottom wall of the base and with the plurality of first bits received in the compartment when the first bit seat is in the storage position, with the first abutment portion of the first bit seat abutting the first rib of the base when the first bit seat is in the extended position, wherein the first bit seat is retained in the storage position when the cover is in a closing position covering the compartment of the base, the cover is pivotable relative to the base to a position in which the cover and the base are in an inverted V-shaped state and placeable on a platform, the first abutment portion of the first bit seat abuts the first rib of the base under action of weights of the plurality of first bits, retaining the first bit seat is in the extended position.

2. The toolbox as claimed in claim 1, with the longitudinal axis of each of the plurality of first bit grooves located corresponding to a vertical axis perpendicular to the platform when the cover and the base are in the inverted V-shaped state and when the first abutment portion of the first bit seat abuts the first rib of the base.

3. The toolbox as claimed in claim 2, with the longitudinal axis of each of the plurality of first bit grooves inclined towards an outer face of the base and at an acute angle to the vertical axis.

4. The toolbox as claimed in claim 1, with the base further including first and second mounting plates on the bottom wall and including a pair of aligned pivot holes, with each of the pair of aligned pivot holes including an opening defined in an upper end thereof and having a width smaller than a diameter of one of the pair of aligned pivot holes, with an inclined face extending upward from an edge of each of the openings, with each of the first and second mounting plates further including a recess having a wall contiguous to the inclined face, allowing expansion of the opening, with the first pivotal column including two ends each having an axle pivotably received in one of the pair of aligned pivot holes.

5. The toolbox as claimed in claim 4, with the first rib extending in a direction parallel to a pivot axis defined by the pivot holes of the mounting plates, with the first abutment portion of the first bit seat located on the first pivotal column.

6. The toolbox as claimed in claim 5, with the bottom wall of the base further including a plurality of partitioning plates each extending in the length direction, with a receiving space defined between two adjacent partitioning plates, with each of the plurality of first bit grooves aligned with one of the plurality of partitioning plates.

7. The toolbox as claimed in claim 4, with the extension of the cover including a rear end having a downwardly extending peripheral wall, with the extension of the cover further including two lateral walls between which the peripheral wall extend, with a receiving space defined between the peripheral wall and the lateral walls.

8. The toolbox as claimed in claim 7, with each of the two extensions of the base including a pivot hole, with a plurality of positioning holes located around the pivot holes of each of the two extensions of the base, with a pivotal portion provided on each of the two lateral walls of the cover and pivotably engaged with the pivot holes of the two extensions of the base, with each of the pivotal portions of the cover including a positioning member engaged with one of the plurality of positioning holes of one of the two extensions of the base and with an outer face of the peripheral wall of the cover abutting the rear wall of the base when the base and the cover are in the inverted V-shaped state.

9. The toolbox as claimed in claim 8, with the front wall of the base including an inner face having an engagement section, with the cover including a covering portion, with the covering portion covering the compartment when the cover is in the closing position, with the covering portion including a front end having an engaging member, with the engaging member engaged with the engagement section of the base when the cover is in the closing position.

10. The toolbox as claimed in claim 8, with the base including a rear face having a coupling portion, with a hook provided on the coupling portion.

11. The toolbox as claimed in claim 1, with the bottom wall including a second rib spaced from the first rib in the length direction, with the toolbox further comprising a second bit seat received in the compartment of the base and spaced from the first bit seat in the length direction, with the second bit seat including a second pivotal column pivotably connected to the base, with the second bit seat further including a second abutment portion, with the second pivotal column including an outer periphery having a plurality of second bit grooves for receiving a plurality of second bits, with the second bit seat pivotable between a storage position and an extended position, with a longitudinal axis of each of the plurality of second bit grooves parallel to the bottom wall of the base and with the plurality of second bits received in the compartment when the second bit seat is in the storage position, with the second abutment portion of the second bit seat abutting the second rib of the base when the second bit seat is in the extended position, wherein the second bit seat is retained in the storage position when the cover is in a closing position closing the compartment of the base, the second abutment portion of the second pivotal column abuts the second rib of the base under action of weights of the plurality of second bits when the base and the cover are in the inverted V-shaped state, retaining the second bit seat is in the extended position.

* * * * *